United States Patent [19]

Wheeldon et al.

[11] 3,954,132

[45] May 4, 1976

[54] MANUFACTURE OF CAST FERROUS METAL DIES

[75] Inventors: John Robert Wheeldon, Worcester; Jeffrey Keith Wheeldon, Alcester, both of England

[73] Assignee: Selly Oak Diecastings Limited, Worcester, England

[22] Filed: June 18, 1974

[21] Appl. No.: 480,557

[30] Foreign Application Priority Data

June 22, 1973 United Kingdom ..... 57197/72

[52] U.S. Cl. ..... 164/23; 164/37; 164/45; 164/72; 164/122

[51] Int. Cl.[2] ..... B22C 9/00

[58] Field of Search ..... 164/15, 23, 37, 45, 164/72, 122, 235, 364, 365; 249/114, 115

[56] References Cited

UNITED STATES PATENTS

| | | | |
|---|---|---|---|
| 1,043,809 | 11/1912 | Dickinson | 249/114 X |
| 1,483,018 | 2/1924 | Shoemaker | 164/37 |
| 2,396,195 | 3/1946 | Pattison | 164/45 |
| 3,565,163 | 2/1971 | Owen et al. | 164/364 X |
| 3,669,180 | 6/1972 | Moore et al. | 164/122 |

FOREIGN PATENTS OR APPLICATIONS

| | | | |
|---|---|---|---|
| 38-18801 | 9/1963 | Japan | 249/114 |

*Primary Examiner*—Ronald J. Shore
*Assistant Examiner*—Gus T. Hampilos
*Attorney, Agent, or Firm*—Watson, Cole, Grindle & Watson

[57] ABSTRACT

A method of manufacturing a cast ferrous metal die wherein an initial die of non-ferrous metal is cast in a mould against a basic metal pattern having a melting point substantially not less than that of the non-ferrous casting metal, the basic metal pattern being preheated and coated with refractory material and the non-ferrous casting metal is cast against the preheated and coated basic pattern in a supercooled condition to minimise thermal shock and heat transference between the casting metal and basic pattern, and forming a further corresponding pattern of refractory material in the initial die, and then using the pattern of refractory material in a mould for casting a cast ferrous metal die from said refractory pattern, the cast ferrous metal die so obtained being of corresponding accuracy to the basic metal pattern.

5 Claims, 4 Drawing Figures

MANUFACTURE OF CAST FERROUS METAL DIES

The object of this invention is to provide a method of manufacture of cast ferrous metal dies whereby such ferrous metal dies can be quickly and economically produced to a high degree of accuracy for the purpose of subsequent production of aluminum or similar non-ferrous castings as well as ferrous castings and also mouldings in plastics or ceramic material or in glass. The invention also includes the manufacture of male dies for press tool or other forming purposes. Practical advantages of the invention will be apparent from the following disclosure.

Whereas for the purpose of this invention and as hereinafter described it is convenient in practice to cast the initial die of non-ferrous aluminum or an alloy thereof especially from a basic pattern also of aluminum or an alloy thereof; other metals may be employed such as zinc, or alloys thereof (e.g. brass) alloys of copper (e.g. brass or bronze), whilst further metals and their alloys include magnesium, lead and titanium. With the exception of lead, the basic pattern from which the metal die is cast, may be of a corresponding metal or a suitable metal having a melting point substantially the same as, or higher than, that of the casting or pouring metal.

The basic pattern is preheated and coated with refractory material to minimise thermal shock and heat transference from the non-ferrous casting metal to the basic pattern and also the casting metal is poured in a super-cooled condition against the basic pattern in order to keep liquid to solid contraction of said metal to a minimum. Together with the condition of the casting metal, the refractory coating also avoids or minimises fusion between the casting metal and basic pattern whilst the coating is preferably pimpled to permit dispersal of entrapped air.

Figure 1:
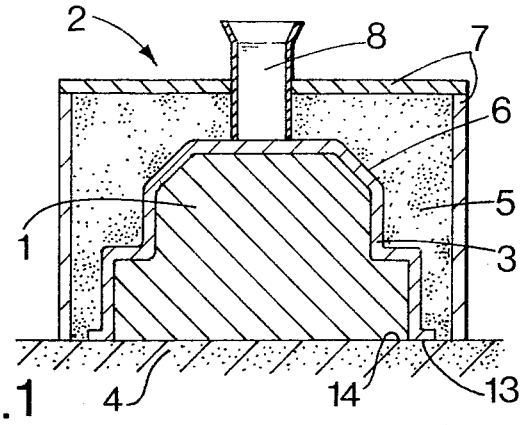
Figure 2:
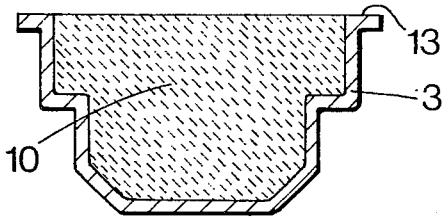
Figure 3:
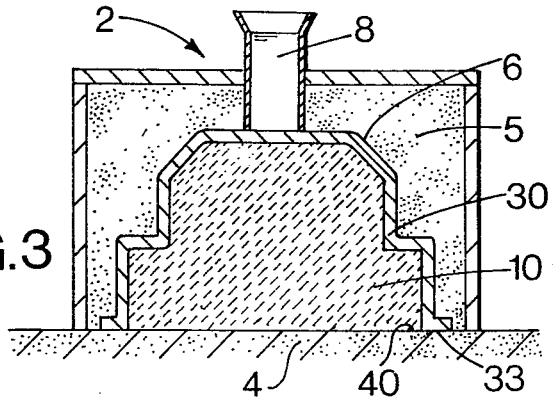
Figure 4:
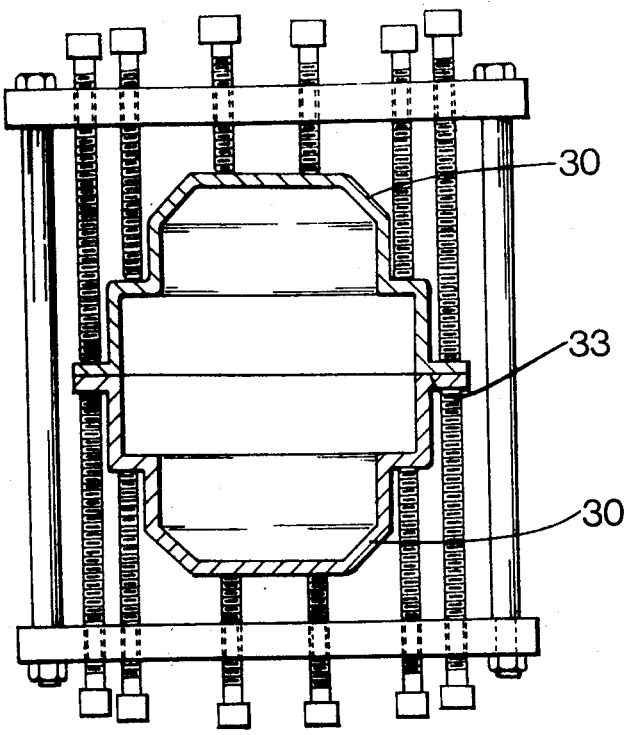

In practice one form of procedure is as follows, reference being had to the accompanying diagrammatic drawings in which:

FIGS. 1 to 3 are cross sectional views each showing a stage in the manufacture of a cast ferrous metal die, and FIG. 4 shows complementary ferrous dies clamped together during normalizing.

The term "aluminum" used herein includes any suitable alloy thereof whilst the term "die" used in the following description includes a casting or moulding cavity but in an appropriate manner can also include a male die of upstanding or positive form. Complementary dies are usually employed in sets of two or more dies when producing castings or mouldings therein.

Referring to FIG. 1 an accurate aluminum basic pattern 1 is first produced from a wooden or other pattern in a sand mould. More than one basic aluminum pattern 1 may be made in this way for producing corresponding dies according to the form of the production castings or mouldings required.

Contraction allowances are incorporated as necessary in the basic aluminum pattern 1 for contraction of the final cast ferrous metal die produced and also for the product subsequently cast or moulded in the final die set and dependent on the metal or material of said product.

After cleaning and degreasing the aluminum basic pattern 1 is bedded at 4 to a predetermined joint face line 14 e.g. in a plastic refractory medium such as a suitable sand above which a mould 2 is provided in further plastic refractory medium 5 with clearance 6 above and about the aluminum basic pattern 1 to predetermined dimensions corresponding to the external shape and wall thickness of the initial die to be produced. Such moulding is suitably supported e.g. by metal plates 7 and provided with a pouring inlet 8 or more than one such inlet according to requirements determined by the shape and/or size of the aluminum basic pattern 1.

After bedding of the basic pattern 1 at 4 and formation of the mould 2 the latter is temporarily removed. The basic pattern is then initially heated to approximately 150°C and a layer of suitable refractory coating is applied to its operative surfaces, which coating may consist of finely divided zirconium dioxide in a solution of sodium silicate and water. The temperature of the pattern is then raised to a temperature of the order of 350° to 400°C and a further layer of the refractory coating is applied, the final result of which is to create a finely pimpled air conductive coating on the pattern 1. The purpose of the coating is to protect the pattern 1 from direct initial thermal shock during casting of the initial die 3 by delaying heat transference while it also provides a means of permitting entrapped air to be dispersed. Further in this latter respect auxiliary vents having porous plugs e.g. of silica sand may be provided in the aluminum basic pattern 1 as necessary.

In some cases the aluminum basic pattern 1 may be bedded in a chill plate instead of plastic refractory medium, the plate providing an appropriate joint face line and also serves as a heat sink to absorb heat from the casting or pouring metal during casting of the initial die 3.

In order to obtain maximum expansion of the aluminum basic pattern 1 prior to pouring the casting metal (i.e. aluminum), the temperature of the pattern 1 is maintained at approximately 350°–400°C for this purpose.

The molten aluminum providing the pouring metal is, after cleaning, subjected to cooling and agitation in such a manner as to lower the temperature of the liquid metal to a point equal to or below its normal solidification point, i.e. the liquid metal is super-cooled. When this condition is reached the agitation is maintained and the liquid metal rapidly transferred to the replaced mould 2 until a sufficient head is obtained in the pouring inlet 8. This head should be greater than normal casting practice (e.g. two to four times as great) in order to subject the casting metal 3 in the mould 2 to sufficient pressure for intimate contact with the basic pattern 1 and also to provide a reserve of the casting metal.

As a result of the abovementioned agitation, the primary crystals of the liquid aluminum are not permitted to form a matrix but are maintained as individual crystals in the euctectic condition of the casting metal and which in turn results in fluidity of the metal being maintained for pouring purposes at a temperature below the normal solidification point of the metal.

Together with the pre-heating of the basic pattern 1 and in particular by reducing the temperature of the pouring metal to a minimum, a very large proportion of the liquid to solid contraction of the metal is removed with the result that the initial die 3 cast about the aluminum basic pattern 1 conforms to the latter with a high degree of accuracy which is further ensured by the hydrostatic pressure due to the head of the pouring metal which is provided in the inlet 8.

After cooling the basic pattern 1 may be removed and any slight irregularities at the joint face 13 of the cast die 3 removed, which joint face 13 is formed at 14 against the sand or plastic refractory medium of the bedding 4 or against the chill plate if the latter is employed. Any necessary location points are machined in the joint face 13.

The above operation is repeated with the same aluminum pattern 1 or with an appropriate pattern according to the symmetrical or other required form of the production castings, the procedure ensuring that accurate mating joint faces 13 are obtained.

Whereas for many purposes a complete die set consists of two complementary dies it is to be understood that it may consist of three or more complementary dies with appropriate joint facing, and that such dies and resulting die sets can be produced in accordance with this invention.

The or each initial die 3 produced in this way is then used for the purpose of moulding a pattern 10 (FIG. 2) in a ceramic or other refractory medium e.g. in resin bonded zirconium dioxide or a suitable bonded heat stable sand such as Zircon or Chromite e.g. incorporating a hot or cold setting agent such as a resin and catalyst. The accurate refractory pattern 10 obtained in this way is then used in a conventional casting process to produce a final ferrous (i.e. iron or steel) metal die 30 (FIG. 3) of corresponding accuracy to a joint face 33 at 40 and which, in conjunction with a complementary die produced in the same way is used for production casting in aluminum or other non-ferrous metals as well as in ferrous metals.

The or each initial aluminum die 3 can thus be employed for the moulding of any suitable number of refractory patterns 10 in obtaining corresponding final ferrous metal dies 30, the refractory patterns 10 being expendable in that they can only be used once in the production of a subsequent cast ferrous metal die 30.

In order to ensure or obtain intimate joint face contact of complementary cast ferrous metal dies 30, they are preferably subject to a normalising process in which the complementary dies are heated e.g. up to 800°C (but preferably not more than this temperature) and while hot they are then clamped together (FIG. 4) with abutting joint faces 33, the clamping being maintained during cooling.

The whole process enables cast ferrous metal dies 30 to be produced to a high degree of accuracy whilst it will be appreciated that the said ferrous dies 30 can be solely and economically produced to such accuracy by casting only and that recourse to machining and the expense of the latter is avoided or very largely minimised.

It is emphasised that any temperature or other values quoted herein are given by way of practical example only and may be varied according to requirements.

We claim:

1. Method of manufacturing a cast ferrous metal die comprising the steps of casting an initial die of non-ferrous metal against a basic metal pattern in a mould, the metal of said basic pattern having a melting point substantially not less than that of the non-ferrous casting metal of the initial die, said basic pattern being preheated and coated with refractory material immediately prior to said casting of the initial die while on casting of the latter the non-ferrous metal is introduced into the mould and against the preheated and coated basic pattern at a temperature below the normal solidification point of the non-ferrous casting metal so as to minimize thermal shock and heat transference between the casting metal and basic pattern, removing the cast initial die from the mould; forming a further corresponding pattern of bonded refractory material in the initial die; removing said further pattern from the initial die and placing it in a mould; and casting in said last mentioned mould and against said further pattern of bonded refractory material a corresponding cast ferrous metal die.

2. Method of manufacturing a cast ferrous metal die according to claim 1 wherein the non-ferrous metal of the cast initial die is selected from the group consisting of aluminum, zinc, magnesium, lead, titanium (including alloys thereof) and copper alloy, the basic metal pattern being of a metal having a melting point not less than that of said non-ferrous casting metal of the initial die.

3. Method of manufacturing a cast ferrous metal die according to claim 1 wherein the non-ferrous casting metal of the initial die consists of aluminum (including an alloy thereof) and the basic metal pattern consists of any one of the metals aluminum (including an alloy thereof) and copper alloy.

4. Method of manufacturing a cast ferrous metal die according to claim 1 wherein the basic metal pattern consists of aluminum (including an alloy thereof) and is preheated to a temperature of the order to 350° to 400°C and coated during said preheating with refractory material immediately prior to casting the initial die of aluminum (including an alloy thereof) against said basic metal pattern in the mould.

5. Method of manufacturing a cast ferrous metal die wherein complementary dies of a set thereof when each produced by the method according to claim 1 are heated and clamped together at complementary joint facing of said dies and allowed to cool while clamped together in order to ensure accurate mating of the joint facing.

* * * * *